US007708003B1

(12) United States Patent
Gavieres

(10) Patent No.: US 7,708,003 B1
(45) Date of Patent: May 4, 2010

(54) FOOTBALL THROWING SYSTEM

(76) Inventor: Gino G. Gavieres, 3653 Avocado Village Ct., #113, Lamesa, CA (US) 91941

( * ) Notice: Subject to any disclaimer, the term of this patent is extended or adjusted under 35 U.S.C. 154(b) by 300 days.

(21) Appl. No.: 11/690,431

(22) Filed: Mar. 23, 2007

(51) Int. Cl.
*F41B 4/00* (2006.01)

(52) U.S. Cl. ..... 124/78

(58) Field of Classification Search ..... 124/6, 124/78

See application file for complete search history.

(56) References Cited

U.S. PATENT DOCUMENTS 1,223,386 A * 4/1917 Handelan ..... 473/436
3,306,613 A * 2/1967 Mainers ..... 473/436
3,977,386 A 8/1976 Meyer
4,122,822 A 10/1978 Scheiwiller
4,299,383 A * 11/1981 Yuasa ..... 473/436
4,391,264 A 7/1983 Abraham et al.
4,723,532 A 2/1988 Osojnak
4,826,166 A 5/1989 Baker et al.
4,841,945 A * 6/1989 Braden ..... 124/78
D309,327 S 7/1990 Chapman
5,417,196 A 5/1995 Morrison et al.
D359,538 S 6/1995 Hague
5,688,196 A 11/1997 O'Neil
6,224,503 B1 5/2001 Joseph

* cited by examiner

*Primary Examiner*—John Ricci

(57) ABSTRACT

A football throwing system for propelling a football down field to be caught and receiving the football when the football is thrown back includes at least one receiver assembly being positioned on a support surface. The receiver assembly receives footballs. A housing is positioned on the support surface. The housing is coupled to the at least one receiver assembly to receive the footballs from the at least one receiver assembly. A pair of conveyor drives is positioned in the housing. Each of the conveyor drives is orientated along a height of the housing. Each of the conveyor drives engages one of the footballs in the housing and lifts the football towards a top end of the housing. A plurality of wheel assemblies is mounted to the housing. The wheel assemblies receive one of the footballs from the conveyor drives and propel the football down field to be caught.

18 Claims, 6 Drawing Sheets

FOOTBALL THROWING SYSTEM

BACKGROUND OF THE INVENTION

1. Field of the Invention

The present invention relates to football throwing machines and more particularly pertains to a new football throwing machine for propelling a football down field to be caught and also for receiving the football when the football is thrown back.

2. Description of the Prior Art

The use of football throwing machines is known in the prior art. While these devices fulfill their respective, particular objectives and requirements, the need remains for a system that has certain improved features that allow for a person to practice receiving a football propelled down field as well as practice throwing a football at a target. Additionally, the system should receive the football thrown by the person and recycle the football into the system to be propelled down field again.

SUMMARY OF THE INVENTION

The present invention meets the needs presented above by generally comprising at least one receiver assembly being positioned on a support surface. The receiver assembly receives footballs. A housing is positioned on the support surface. The housing is coupled to the at least one receiver assembly to receive the footballs from the at least one receiver assembly. A pair of conveyor drives is positioned in the housing. Each of the conveyor drives is orientated along a height of the housing. Each of the conveyor drives engages one of the footballs in the housing and lifts the football towards a top end of the housing. A plurality of wheel assemblies is mounted to the housing. The wheel assemblies receive one of the footballs from the conveyor drives and propel the football down field to be caught.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
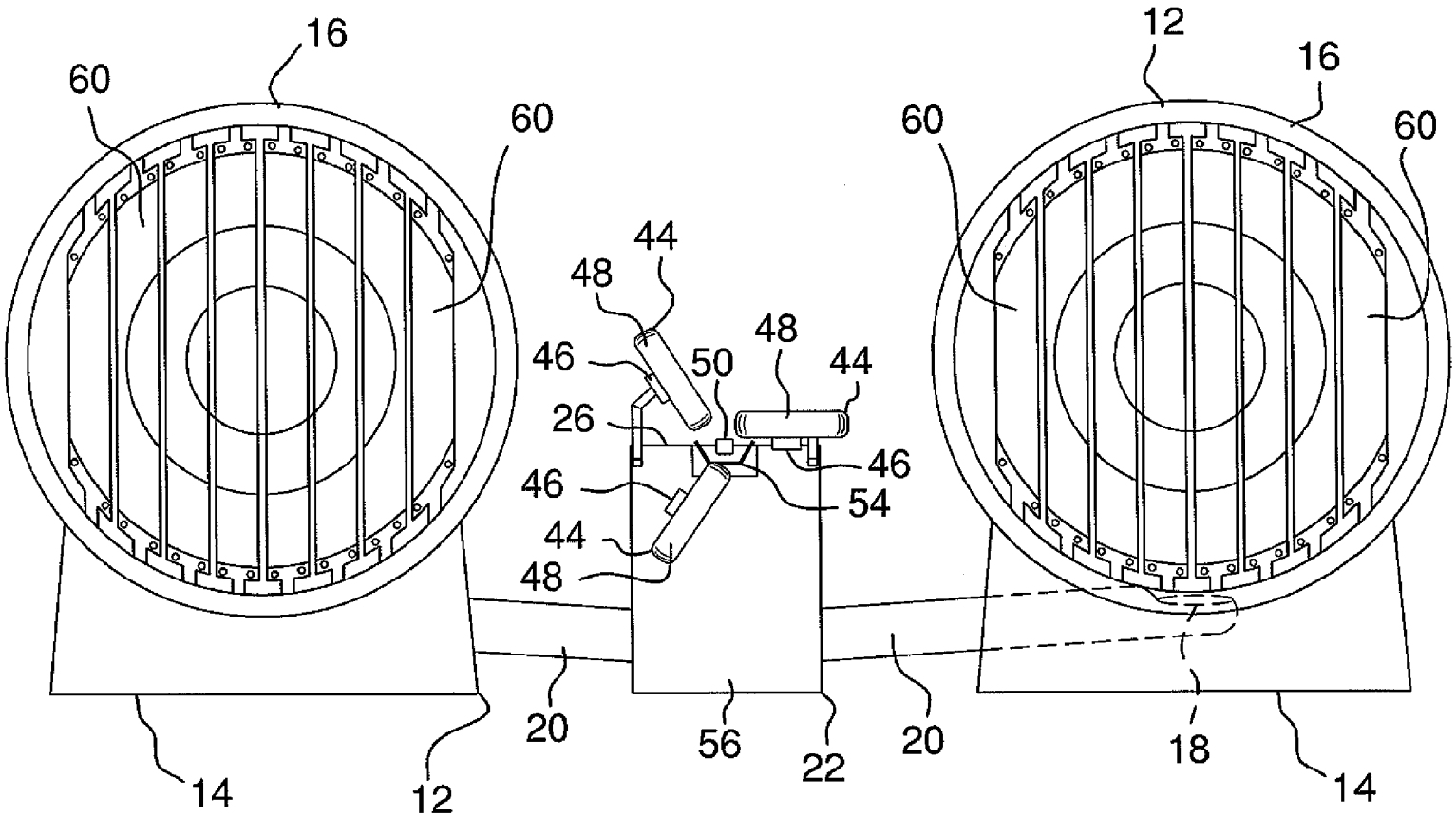
FIG. 1 is a front view of a football throwing system according to the present invention.
Figure 2:
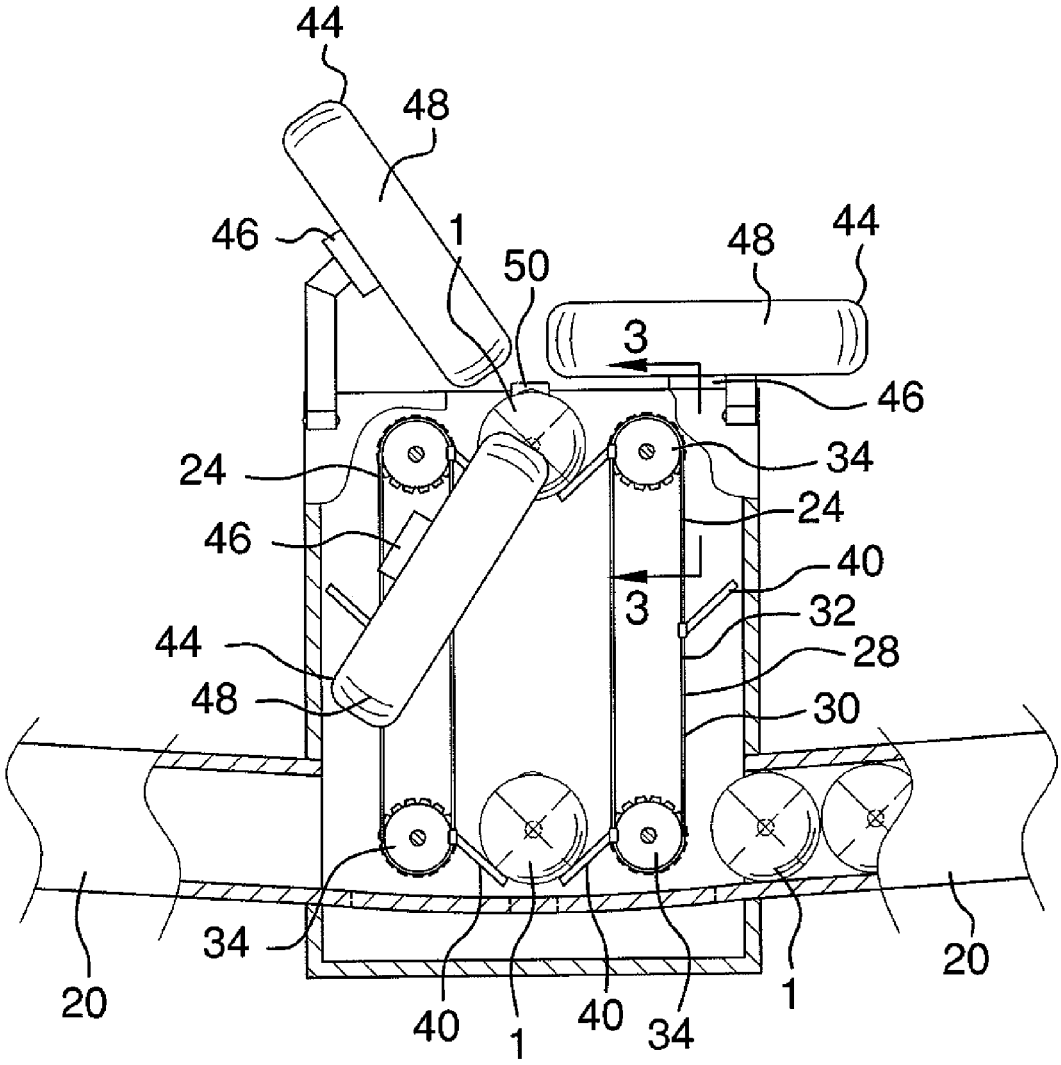
FIG. 2 is an enlarged front view of the housing of the present invention with a portion of a front wall of the housing removed.
Figure 3:
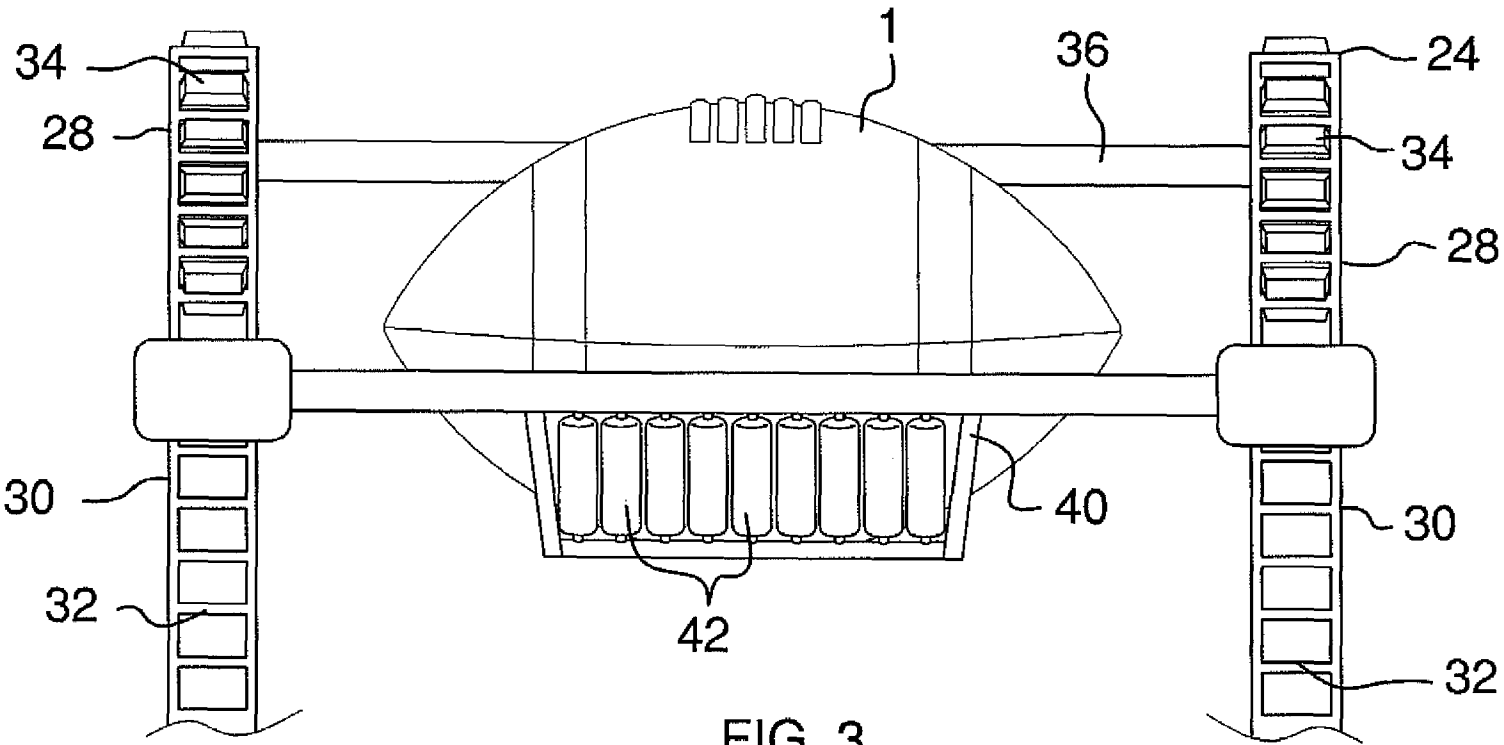
FIG. 3 is a side view of a portion of one of the conveyor drives of the present invention as taken along line 3-3 of FIG. 2.
Figure 4:
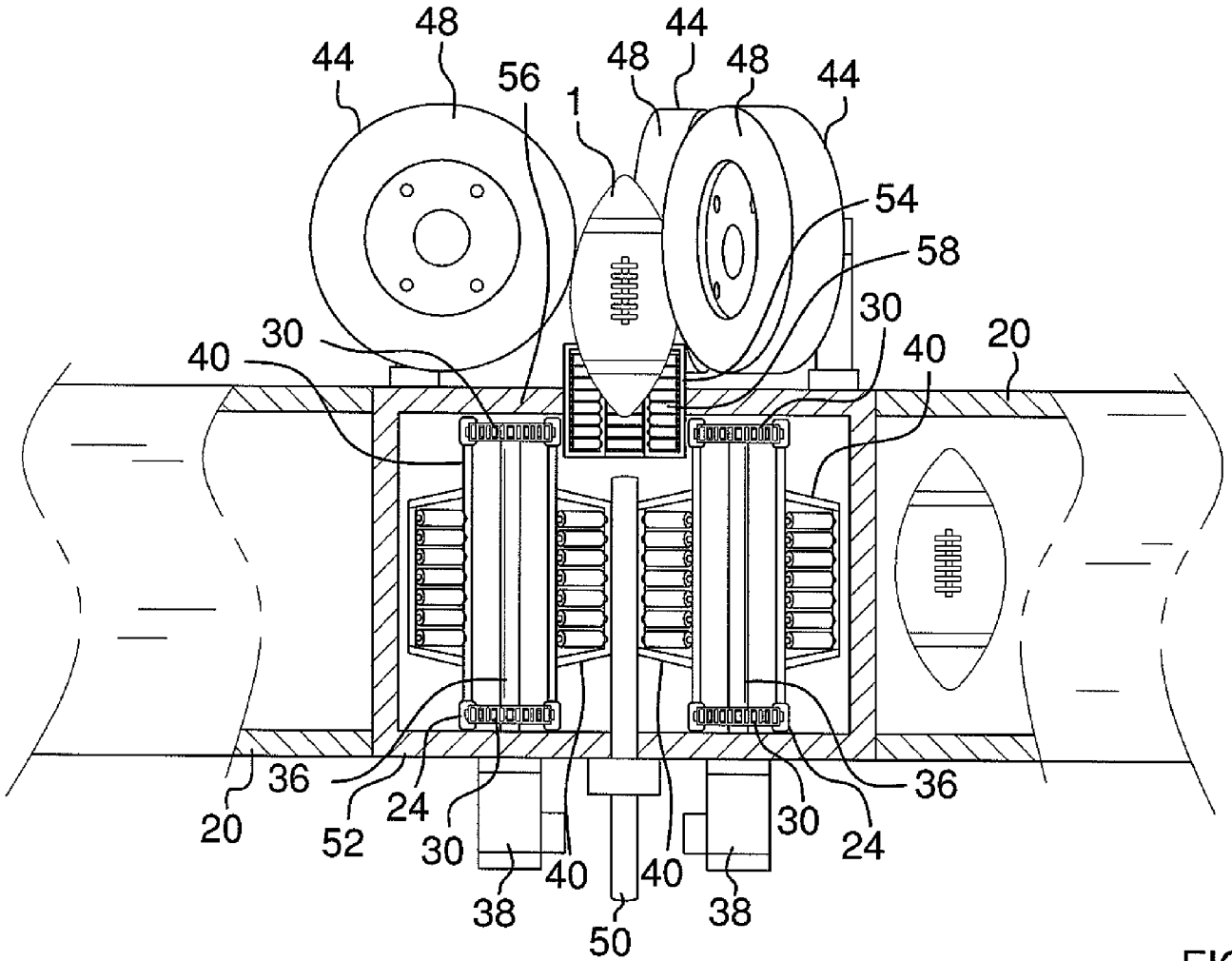
FIG. 4 is an enlarged top view of the housing of the present invention with a portion of the housing removed.

With reference now to the drawings, and in particular to FIGS. 1 through 7 thereof, a new football throwing machine embodying the principles and concepts of the present invention and generally designated by the reference numeral 10 will be described.

As best illustrated in FIGS. 1 through 7, the football throwing system 10 generally comprises at least one receiver assembly 12 being positioned on a support surface, such as a playing field surface. The receiver assembly 12 receives footballs 1. The at least one receiver assembly 12 includes a base 14 positioned on the support surface. The at least one receiver includes a bowl 16 pivotally coupled to and upwardly extending from the base 14. An angle of a front face 17 of the bowl 16 is adjustable with respect to the base 14 to change an angle at which said at least one receiver assembly 12 receives the foot balls 1. The base 14 has a receiving aperture 18 therein. The bowl 16 receives one of the footballs 1 thrown at it and directs the football 1 to the receiving aperture 18. The at least one receiver assembly 12 includes a chute 20 pivotally coupled to the base 14 and in communication with the receiving aperture 18. The base 14 is pivotally adjustable with respect to the chute 20 to permit horizontal adjustment of the at least one receiving assembly 12. The chute 20 receives the footballs 1 passing through the receiving aperture 18 from the bowl 16. A housing 22 is positioned on the support surface. The housing 22 is coupled to the chute 20 of the at least one receiver assembly 12 to allow the footballs 1 to enter the housing 22.

A pair of conveyor drives 24 is positioned in the housing 22. Each of the conveyor drives 24 is orientated along a height of the housing 22. Each of the conveyor drives 24 engages one of the footballs 1 in the housing 22 and lifts the football 1 towards a top end 26 of the housing 22. Each of the conveyor drives 24 includes a drive mechanism 28 positioned in the housing 22. The drive mechanism 28 includes a pair of drive chains 32. Each of the drive chains 32 includes a chain 32 extending in an endless loop around a pair of gears 34 rotatably mounted in the housing 22 and vertically spaced from each other. The drive chains 32 are spaced apart to permit the footballs 1 to pass between the drive chains 32. A transfer rod 36 is coupled an uppermost one of the gears 34 of each of the drive chains 32.

Each of the conveyor drives 24 also includes a conveyor motor 38 coupled to one of the gears 34 of one of the drive chains 32 to rotate the associated one of the gears 34 and thereby the chain 32. The transfer rod 36 transfers rotation of one of the drive chains 32 to the other one of the drive chains 32. Each of a plurality of lift brackets 40 is coupled to the drive mechanism 28. One of the lifting brackets from each of the conveyor drives 24 cradles one of the footballs 1 and lifts the football 1 towards the top end 26 of the housing 22 when the conveyor drives 24 are actuated. Each of the lift brackets 40 is coupled to and extends between the chains 32. Each of the lift brackets 40 includes a plurality of lift rollers 42 to minimize resistance to the football 1 being pushed off of the lift brackets 40.

Each of a plurality of wheel assemblies 44 is mounted to the housing 22. The wheel assemblies 44 receive one of the footballs 1 from the conveyor drives 24 and propel the football 1 down field to be caught. Each of the wheel assemblies 44 includes a drive motor 46 mounted to the housing 22. The drive motor 46 is positioned adjacent the top end 26 of the housing 22. A wheel 48 is coupled to the drive motor 46. The wheel 48 is rotated by the motor when the drive motor 46 is actuated. The wheel 48 of each of the wheel assemblies 44 frictionally contacts one of the footballs 1 conveyed to the top end 26 of the housing 22 and propels the football 1 downfield.

The wheel 48 of one of the wheel assemblies 44 rotates in an approximately horizontal plane, wherein the horizontal plane includes a longitudinal axis of the football 1 to be propelled. The wheel 48 of one of the other wheel assemblies 44 extends at a downward angle from the horizontal. The wheel 48 of one of the other wheel assemblies 44 extends at an upward angle from the horizontal. The wheels 48 extending at the downward angle and at the upward angle from the horizontal engage the football 1 off center to provide a rotational spin around the longitudinal axis of the football 1 when the football 1 is propelled. The wheels 48 extending at the downward angle and the upward angle from horizontal are each positioned at angle between approximately 35 degrees and approximately 60 degrees from horizontal.

A ram 50 is coupled to a rear wall 52 of the housing 22. The ram 50 is extendable across the top end 26 of the housing 22 when the ram 50 is actuated. The ram 50 pushes each of the footballs 1 conveyed to the top end 26 by the conveyor drives 24 into the wheel assemblies 44 to be propelled downfield when each of the footballs 1 is positioned adjacent the top end 26.

A cradle 54 is coupled to a front wall 56 of the housing 22 and positioned adjacent the top end 26. The cradle 54 is positioned between the ram 50 and the wheel assemblies 44. The cradle 54 receives the football 1 pushed by the ram 50 to stabilize the football 1 for proper alignment with the wheel assemblies 44. The cradle 54 includes a plurality of cradle rollers 58 to minimize resistance to the football 1 moving across the cradle 54.

Figure 5:
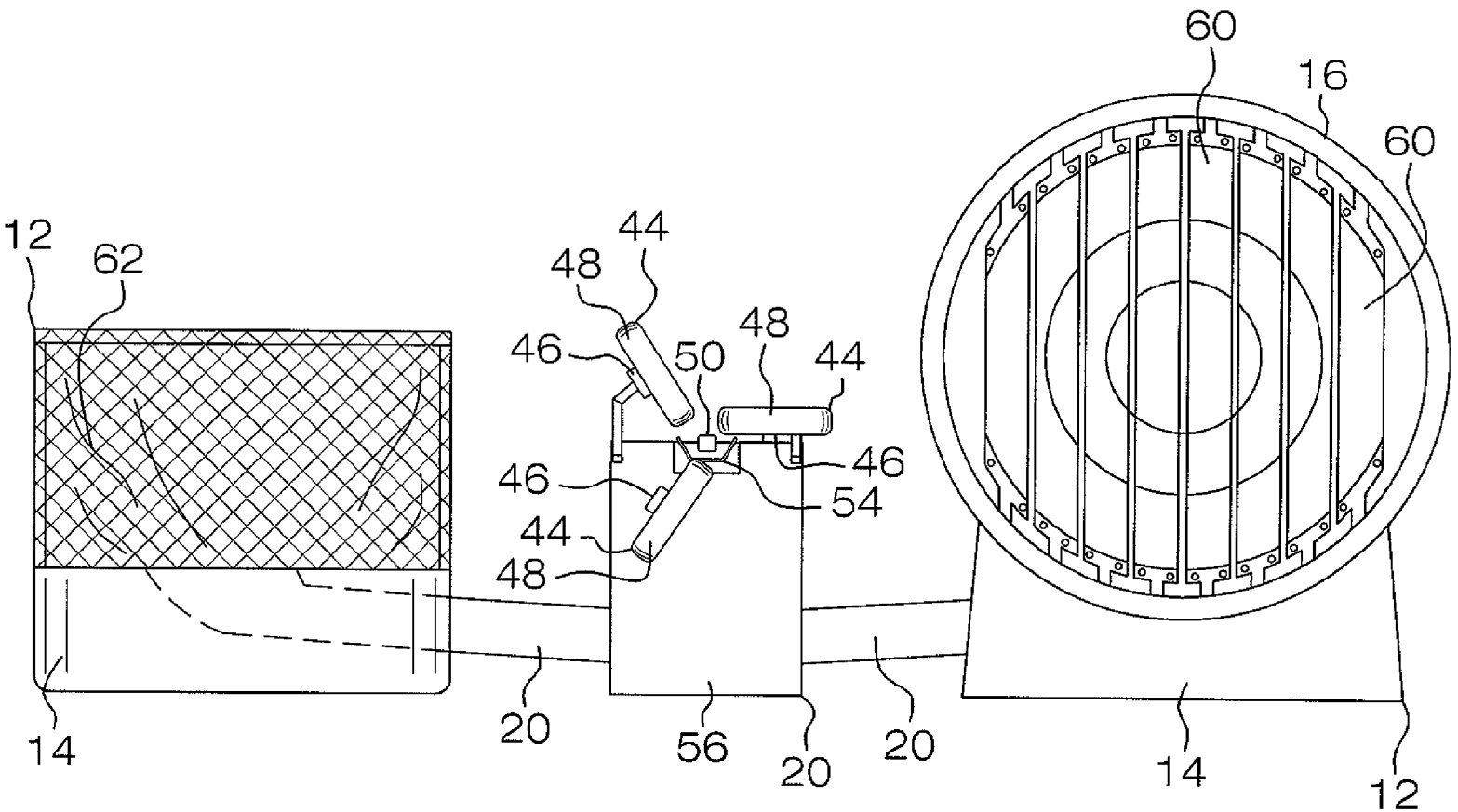
FIG. 5 is a front view of the present invention showing an embodiment of one of the receiver assemblies.
Figure 6:
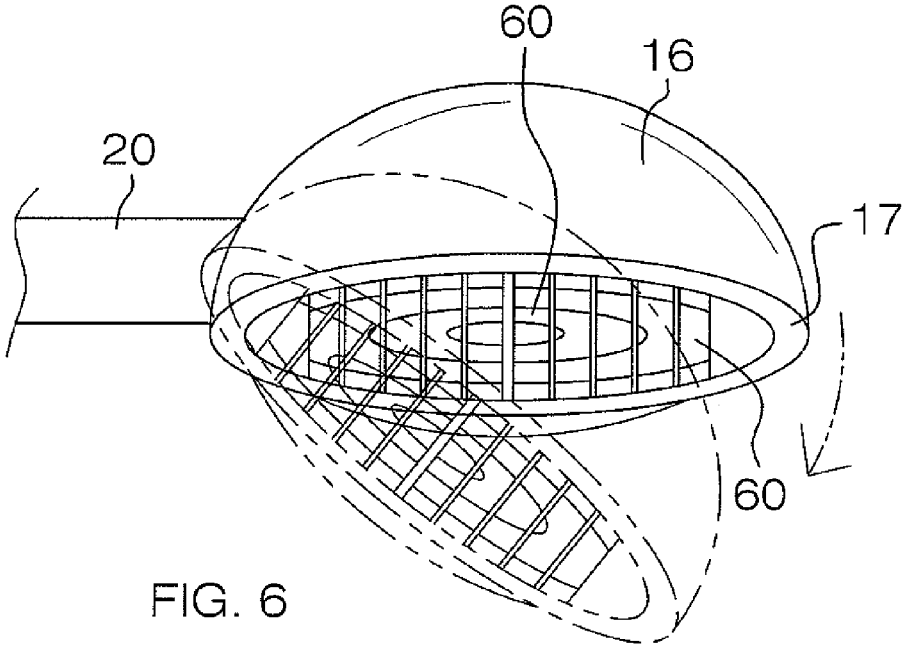
FIG. 6 is a perspective view of the present invention of one of the receiver assemblies.
Figure 7:
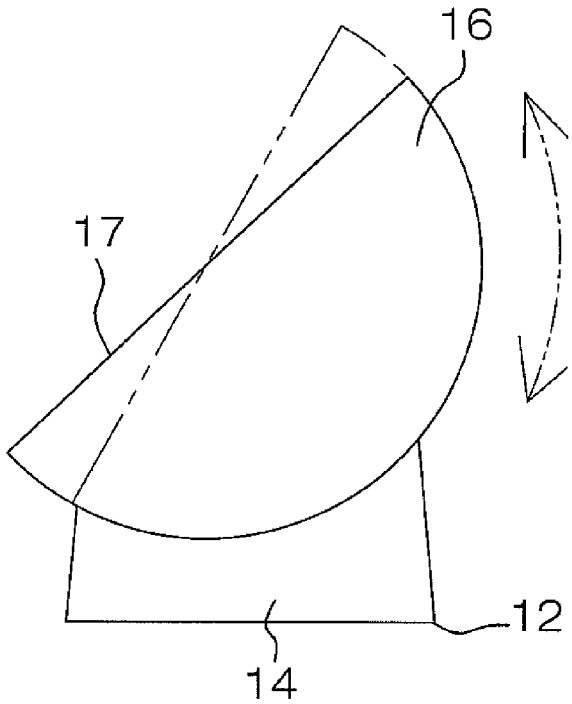
FIG. 7 is a side view of the present invention of one of the receiver assemblies.

The at least one receiver assembly 12 includes a plurality of panels 60 being rotatably coupled to the bowl 16. Each of the panels 60 is aligned with the front face 17 of the bowl. As the football 1 passes into the bowl 16 the panels 60 adjacent the football 1 pivot and frictionally contact the football 1 to slow the football 1 as it passes through the panels 60. Each of the panels 60 is biased to return to a position aligned with the front face 17 of the bowl 16. The panels 60 may be printed with a design to entice a thrower of a football 1 to aim for the center of the bowl 16. In an embodiment of the at least one receiver assembly 12, as shown in FIG. 5, a hopper 62 extends upwardly from the base to receive a football 1 dropped into the hopper 62. The hopper 62 is comprised of a mesh material.

In use, the at least one receiver assembly 12 is positioned on the support surface. The chute 20 of the at least one receiver assembly 12 is mounted to the housing 22 so that the footballs 1 received by the at least one receiver assembly 12 are delivered to the housing 22. The conveyor drives 24 are actuated and lift one of the footballs 1 to the top end 26 of the housing 22. As the football 1 reaches the top end 26 of the housing 22 the ram 50 pushes the football 1 onto the cradle 54 and into the wheel assemblies 44. The wheel assemblies 44 frictionally contact the football 1 and propel the football 1 down field to simulate a spiral pass being thrown. Once the football 1 has been caught or retrieved, the football 1 is thrown into the bowl 16 of the at least one receiver assembly 12 to allow the football 1 to be propelled down field again.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A football throwing system for throwing footballs, said system comprising:

at least one receiver assembly being positioned on a support surface, said receiver assembly receiving the footballs, said at least one receiver assembly includes a base being positioned on the support surface, said at least one receiver including a bowl pivotally coupled to and upwardly extending from said base, said base having a receiving aperture therein, said bowl receiving one of the footballs thrown at it and directing the football to said receiving aperture;

a housing positioned on the support surface, said housing being coupled to said at least one receiver assembly to receive the footballs from said at least one receiver assembly;

a pair of conveyor drives being positioned in said housing, each of said conveyor drives being orientated along a height of said housing, each of said conveyor drives engaging one of the footballs in said housing and lifting the football towards a top end of said housing; and a plurality of wheel assemblies being mounted to said housing, said wheel assemblies receiving one of the footballs from said conveyor drives and propelling the football down field to be caught.

2. The system according to claim 1, wherein said at least one receiver assembly includes a chute being pivotally coupled to said base and in communication with said receiving aperture, said chute receiving the footballs passing through said receiving aperture from said bowl, said housing being coupled to said chute of said at least one receiver assembly to allow the footballs to enter said housing.

3. The system according to claim 1, wherein each of said conveyor drives includes a drive mechanism being positioned in said housing.

4. The system according to claim 3, wherein said drive mechanism includes a pair of drive chains.

5. The system according to claim 4, wherein each of said drive chains includes a chain extending in an endless loop around a pair of gears rotatably mounted in said housing and vertically spaced from each other, said drive chains being spaced apart to permit the footballs to pass between said drive chains.

6. The system according to claim 5, wherein each of said conveyor drives includes a transfer rod being coupled an uppermost one of said gears of each of said drive chains.

7. The system according to claim 6, wherein each of said conveyor drives includes a conveyor motor being coupled to one of said gears of one of said drive chains to rotate the associated one of said gears and thereby said chain, said transfer rod transferring rotation of one of said drive chains to the other one of said drive chains.

8. The system according to claim 3, wherein each of said conveyor drives includes a plurality of lift brackets, each of said lift bracket being coupled to said drive mechanism, one of said lifting brackets from each of said conveyor drives cradling one of the footballs and lifting the football towards said top end of said housing when said conveyor drives are actuated.

9. The system according to claim 8, wherein each of said lift brackets includes a plurality of lift rollers to minimize resistance to the football being pushed off of said lift brackets.

10. The system according to claim 1, wherein each of said wheel assemblies includes a drive motor being mounted to said housing, said drive motor being positioned adjacent said top end of said housing.

11. The system according to claim 10, wherein each of said conveyor drives includes a wheel being coupled to said drive motor, said wheel being rotated by said motor when said drive motor is actuated, said wheel of each of said wheel assemblies frictionally contacting one of the footballs conveyed to said top end of said housing and propelling the football downfield.

12. The system according to claim 1, further comprises a ram being coupled to a rear wall of said housing, said ram being extendable across said top end of said housing when said ram is actuated, said ram pushing each of the footballs conveyed to said top end by said conveyor drives into said wheel assemblies to be propelled downfield when each of the footballs is positioned adjacent said top end.

13. The system according to claim 12, further comprises a cradle being coupled to a front wall of said housing and positioned adjacent said top end, said cradle being positioned between said ram and said wheel assemblies, said cradle receiving the football pushed by said ram to stabilize the football for proper alignment with said wheel assemblies.

14. The system according to claim 13, wherein said cradle includes a plurality of cradle rollers to minimize resistance to the football moving across said cradle.

15. A football throwing system for throwing footballs, said system comprising:

at least one receiver assembly being positioned on a support surface, said receiver assembly receiving the footballs, said at least one receiver assembly including a base being positioned on the support surface, said at least one receiver including a bowl pivotally coupled to and upwardly extending from said base, said base having a receiving aperture therein, said bowl receiving one of the footballs thrown at it and directing the football to said receiving aperture, said at least one receiver assembly includes a chute being pivotally coupled to said base and in communication with said receiving aperture, said chute receiving the footballs passing through said receiving aperture from said bowl, said at least one receiver assembly includes a plurality of panels rotatably coupled to said bowl, each of said panels being aligned with a front face of said bowl, as the football passes into said bowl said panels adjacent the football pivot and frictionally contact the football to slow the football as it passes through said panels, each of said panels is biased to return to a position aligned with said front face of said bowl;

a housing positioned on the support surface, said housing being coupled to said chute of said at least one receiver assembly to allow the footballs to enter said housing;

a pair of conveyor drives being positioned in said housing, each of said conveyor drives being orientated along a height of said housing, each of said conveyor drives engaging one of the footballs in said housing and lifting the football towards a top end of said housing; each of said conveyor drives comprising;

a drive mechanism being positioned in said housing, said drive mechanism including a pair of drive chains, each of said drive chains including a chain extending in an endless loop around a pair of gears rotatably mounted in said housing and vertically spaced from each other, said drive chains being spaced apart to permit the footballs to pass between said drive chains;

a transfer rod being coupled an uppermost one of said gears of each of said drive chains;

a conveyor motor being coupled to one of said gears of one of said drive chains to rotate the associated one of said gears and thereby said chain, said transfer rod transferring rotation of one of said drive chains to the other one of said drive chains;

a plurality of lift brackets, each of said lift bracket being coupled to said drive mechanism, one of said lifting brackets from each of said conveyor drives cradling one of the footballs and lifting the football towards said top end of said housing when said conveyor drives are actuated, each of said lift brackets being coupled to and extending between said chains, each of said lift brackets including a plurality of lift rollers to minimize resistance to the football being pushed off of said lift brackets;

a plurality of wheel assemblies being mounted to said housing, said wheel assemblies receiving one of the footballs from said conveyor drives and propelling the football down field to be caught, each of said wheel assemblies comprising;

a drive motor being mounted to said housing, said drive motor being positioned adjacent said top end of said housing;

a wheel being coupled to said drive motor, said wheel being rotated by said motor when said drive motor is actuated, said wheel of each of said wheel assemblies frictionally contacting one of the footballs conveyed to said top end of said housing and propelling the football downfield;

a ram being coupled to a rear wall of said housing, said ram being extendable across said top end of said housing when said ram is actuated, said ram pushing each of the footballs conveyed to said top end by said conveyor drives into said wheel assemblies to be propelled downfield when each of the footballs is positioned adjacent said top end; and a cradle being coupled to a front wall of said housing and positioned adjacent said top end, said cradle being positioned between said ram and said wheel assemblies, said cradle receiving the football pushed by said ram to stabilize the football for proper alignment with said wheel assemblies, said cradle including a plurality of cradle rollers to minimize resistance to the football moving across said cradle.

16. A football throwing system for throwing footballs, said system comprising:

at least one receiver assembly being positioned on a support surface, said receiver assembly receiving the footballs;

a housing positioned on the support surface, said housing being coupled to said at least one receiver assembly to receive the footballs from said at least one receiver assembly;

a pair of conveyor drives being positioned in said housing, each of said conveyor drives being orientated along a height of said housing, each of said conveyor drives engaging one of the footballs in said housing and lifting the football towards a top end of said housing;

a plurality of wheel assemblies being mounted to said housing, said wheel assemblies receiving one of the footballs from said conveyor drives and propelling the football down field to be caught; and a ram being coupled to a rear wall of said housing, said ram being extendable across said top end of said housing when said ram is actuated, said ram pushing each of the footballs conveyed to said top end by said conveyor drives into said wheel assemblies to be propelled downfield when each of the footballs is positioned adjacent said top end.

17. The system according to claim 16, further comprises a cradle being coupled to a front wall of said housing and positioned adjacent said top end, said cradle being positioned between said ram and said wheel assemblies, said cradle receiving the football pushed by said ram to stabilize the football for proper alignment with said wheel assemblies.

18. The system according to claim 17, wherein said cradle includes a plurality of cradle rollers to minimize resistance to the football moving across said cradle.

* * * * *